US010286415B2

(12) United States Patent
Lithell et al.

(10) Patent No.: US 10,286,415 B2
(45) Date of Patent: May 14, 2019

(54) DISPENSING DEVICE AND METHOD

(71) Applicant: GINOLIS OY, Oulunsalo (FI)

(72) Inventors: Per Oskar Lithell, Oulunsalo (FI); Topi Hintsala, Oulunsalo (FI); Jarmo Paloviita, Oulunsalo (FI)

(73) Assignee: GINOLIS OY, Oulunsalo (FI)

( * ) Notice: Subject to any disclaimer, the term of this patent is extended or adjusted under 35 U.S.C. 154(b) by 0 days.

(21) Appl. No.: 14/796,286

(22) Filed: Jul. 10, 2015

(65) Prior Publication Data

US 2017/0008016 A1 Jan. 12, 2017

(51) Int. Cl.
*B05B 11/00* (2006.01)

(52) U.S. Cl.
CPC ..... *B05B 11/3035* (2013.01); *B05B 11/0072* (2013.01); *B05B 11/3052* (2013.01)

(58) Field of Classification Search
CPC ..... B05B 11/3035; B05B 11/0072; B05B 11/3052
USPC ..... 222/420
See application file for complete search history.

(56) References Cited

U.S. PATENT DOCUMENTS 5,638,986 A * 6/1997 Tuominen ..... B01L 3/0293 222/1
5,711,989 A 1/1998 Ciardella et al.
7,316,336 B2 * 1/2008 Kaartinen ..... G01F 11/086 222/209
8,323,882 B2 12/2012 Moore et al.
2004/0045148 A1 3/2004 Moler
2005/0006417 A1 * 1/2005 Nicol ..... B01L 3/0241 222/420
2007/0129681 A1 * 6/2007 Ott ..... A61M 5/1452 604/152
2010/0273680 A1 * 10/2010 Moore ..... B01J 19/0046 506/26
2010/0294810 A1 * 11/2010 Ikushima ..... B05C 11/1034 222/309
2013/0287607 A1 10/2013 Kuznetsov
2014/0217127 A1 * 8/2014 Ikushima ..... B05C 5/0225 222/420
2015/0119283 A1 4/2015 Moore et al.
2015/0206704 A1 * 7/2015 Momoi ..... G02B 21/26 250/310

FOREIGN PATENT DOCUMENTS

DE 102013108948 A1 2/2015
WO WO2002082024 A1 10/2002
WO WO2004111610 A2 12/2004

OTHER PUBLICATIONS

The International Search Report and Written Opinion of the International Searching Authority for International Application No. PCT/EP2016/066631, dated Oct. 21, 2016, 1 page.

(Continued)

*Primary Examiner* — Jeremy Carroll
(74) *Attorney, Agent, or Firm* — The Marbury Law Group PLLC

(57) ABSTRACT

A system for accurately dispensing small droplets from a positive displacement pumps is actuated by a linear actuator. Preferably the linear actuator is a piezo-actuator. In a method to use the device the system pressure is stabilized before dispensing a plurality of droplets.

3 Claims, 3 Drawing Sheets

(56) References Cited

OTHER PUBLICATIONS

International Search Report (for Further Action—PCT Article 18 and Rules 43 and 44) for International Application No. PCT/EP2016/066631, dated Oct. 21, 2016, 6 pages.
The Written Opinion of the International Searching Authority (For Further Action—PCT Rule 43bis.1) for International Application No. PCT/EP2016/066631, dated Oct. 21, 2016, 7 pages.
Öhman, P. O., "Dispensing Device and Method," U.S. Appl. No. 14/669,399, filed Mar. 26, 2015.

* cited by examiner

Prior Art

DISPENSING DEVICE AND METHOD

BACKGROUND OF THE INVENTION

The present invention relates to the field of devices and methods for dispensing small volumes, such as nanoliters, of liquid using a positive displacement pump. One type of positive displacement pump, known as a "bellows pump" comprises a body with chamber enclosing a bellows wherein the space between the bellows and the chamber walls is intended to be filled with a liquid that is to be dispensed and the liquid is dispensed through an outlet by expansion of the bellows. In another type of bellows pump the liquid to be dispensed is inside the bellows and the liquid is dispensed by moving the free end of the bellows by means of an actuator-driven rod positioned between the free end of the bellows and a fixed part of the pump body. Another type of positive displacement pump is a syringe pump in which the displacement of the piston of a syringe inside a syringe cylinder causes fluid to be sucked into or pressed out of the syringe outlet.

U.S. Pat. No. 5,638,986 describes a bellows pump in which the dosing space is formed by the interior volume of a short bellows which is compressed and expanded along its longitudinal axis by a stretching and contracting rod made of piezo-material which is in direct contact with the centre of an end surface of the bellows. The rod can expand and contract in the longitudinal direction of the bellows and acts on the centre of the bellows. The dosing space changes its volume nonlinearly when the bellows are first compressed slowly from the center thereof and then faster both from the center and the creases of the bellows. As the limited movement of the piezo-material is directly transferred to the bellows the repeatability of the droplet size dispensed is good but only a small number of droplets can be dispensed before the piezo-material reaches the end of its travel and the bellows needs to be re-filed.

U.S. Pat. No. 8,323,882 describes a syringe pump which is driven by a stepper motor and associated lead screw. Such systems can suffer from mechanical problems which affect their accuracy. For example play in the lead screw can lead to inaccurate dispensing where the drops that were intended to be dispensed at the beginning of a dispensing run are not actually dispensed as the system takes up the play in the system. Additionally it is possible that friction or static friction in the system prevents the stepper motor from actually completely a step (and thus fails to dispense any fluid). When the stepper motor is subsequently actuated to make the next step it is possible that it overcomes the friction and moves two steps instead of the newly commanded single step, thereby dispensing twice the intended amount of fluid. This is not a problem when large volumes are intended to be dispensed as these may involve tens or hundreds of continuous steps but in the case of small droplets requiring only one or a few steps this friction means that the repeatability of very small droplets sizes is often poor.

An example of a prior art bellows pump which attempts to overcome the disadvantages of earlier positive displacement pumps is known from WO2002/082024. This describes a bellows-pump in which the actuator is in the form of a voice coil comprising a magnet and a current coil. The magnet (alternatively the current coil) is attached to the movable end of the bellows and the current coil (alternatively the magnet) is attached to the body. The application of an electric current to the current coil produces a magnetic field which attracts or repulses the magnet and thereby changes the volume of the bellows. A decrease in the volume of the bellows forces a similar volume of liquid to leave the bellows via a dispensing nozzle. Such bellows pumps have low friction and thus do not suffer from the friction problems associated with syringe pumps.

FIG. 1 shows an example of a prior art positive displacement pump comprising a body 1 having a top cover 3, a bottom 5 and a cylindrical jacket 7 there between. A flexible bellows 9 is placed centrally in the space defined by the jacket 7. The bellows may be a nickel/cobalt bellows or fiber reinforced plastic bellows or the like. The lower end 10 of the bellows 9 is attached to an intermediate wall 11 which extends across the jacket and the opposite, movable end 13 of the bellows is arranged for linear movement in the axial directions of the bellows and the jacket 7 of the body. The movable end 13 of the bellows is moved by an actuator 17 formed of an axially extending rod 19 attached to a annular current coil 21 and a permanent magnet 23 attached to the bottom 5 of the body, and co-operating magnetically with the current coil. The current coil 21 is directly attached to the moving end 13 of the bellows and arranged to move in the axial direction of the jacket 7 in an annular groove 25 formed in the magnet 23 without contacting the magnet. Electric current may be passed to the current coil 21 through conductors 27, the magnitude of the current being adjusted by a control means such as a microprocessor 29 and drive circuitry. According to the direction of the current, the current coil 21 and the magnet 23 either attract or repel each other. The attraction or repulsion force is dependent on the strength of the current in coil 21. Normally, the current may be adjusted nearly continuously in the available adjusting range. To centralize the end of the bellows and the current coil 21 on the axis of the jacket 7 and to linearize the movements thereof, a centralizer 31 is placed between the jacket and the end of the bellows. The centralizer is represented schematically as a pleated, truncated conical spring. The widest end 33 of the spring is attached to the inner surface of the jacket 7 of the body and the truncated end 35 to the support 36 of the rod connected to movable end 13 of the bellows 9. The centralizer 31 has high lateral rigidity while yielding freely in the axial direction.

In the construction of the positive displacement pump, the spring force of the bellows 9 and the spring force of the centralizer 31 act against each other to balance the movable end 13 of the bellows at a zero position (X=0) in case where there is no electric current in the current coil 21. The movable end 13 of the bellows may thus move on both sides of the balance position according to the direction of the electric current passing through the coil 21.

A liquid chamber 37 filled with the liquid to be dosed is formed between the outside of the bellows 9, the intermediate wall, the jacket and the cover. The dosing operation carried out by the device is based on the volume changes of said liquid chamber. The liquid chamber 37 has a filling channel 39 provided with a pump 41 which can supply liquid from liquid supply 42 and can also act as a valve for closing the space. A dosing channel 43 leads from the liquid chamber to a dosing tip 45 discharging the dosed liquid amount in the form of droplets 47. The device presented may be used for producing test strips for chemical analyses onto a substrate 49 as shown in FIG. 1. Liquid droplets 47 can be injected on the strip 49 from the dosing tip 47. The positive displacement pump shown may be used in productive serial dosing wherein the liquid chamber 37 is filled with the liquid to be dosed, and thereafter, tens or even hundreds of small liquid doses having an equal volume are dosed by means of the actuator 17 constricting the liquid chamber to cause the dosing operations. In the initial position, when the bellows is retracted to its maximum extent, the magnet 23 and the current coil 21 attract each other against the total spring forces of the bellows 9 and the centralizer 15. Then, step by step, the magnitude of the current can be lowered to decrease the attracting forces of the magnet and the coil. This causes the coil and the end of the bellows to move axially away from the magnet, thus constricting the liquid chamber surrounding the bellows in a stepwise manner. Normally each step decrease in the current magnitude corresponds to the discharging of a predetermined amount of liquid 47 from the dosing tip 45. Once the magnitude of the electric current in the coil has reached the value of zero, said balance or zero position (X=0) of the movable end of the bellows is attained. Further dosing is achieved by reversing the direction of the electric current and by increasing the magnitude of the electric current step by step, the repelling force between the magnet and the coil thus pushing the movable end of the bellows against the total spring forces of the bellows and the centralizer and thereby constricting the liquid chamber further. In this manner, the serial dosing can be continued until the movable end of the bellows reaches the end of its practical range of movement +Xp and −Xp—which is normally set by the maximum current which the system can provide to the voice coil which corresponds to the maximum force which the coil can exert and is less than the theoretical maximum movements +Xt and −Xt which could be physically possible in the device.

A problem with such devices is that the working range of the voice coil is limited by the currents needed to move the current coil with respect to the magnet. This is because the current needed to displace the coil from its resting position (i.e. its position when there is no current flowing through it) does not vary linearly with distance but increases quadratically with the distance that the coil is from its resting position. This means that the actual working range of the pump, i.e. the volume that it is able to dispense before it needs refiling is much less than the theoretically-possible working range of the pump as it is limited by the current capacity of (and thus the power able to be generated by) the current coil/magnet actuator of the system. The further the voice coil is from its rest position, the higher the current needed to move it and/or maintain it in position. Apart from requiring a high power power-supply that is only used at its full capacity when the voice coil reaches the extremes of its range, the currents drawn by the voice coil generate heat in the system that can affect dispensing accuracy and stability. Furthermore the voice coil leads to inductive loads in the electrical circuits which have to be designed to withstand these loads.

A further drawback with a voice coil driven bellows pump is that it is not stiff in the axial dimension. Such an electromagnetic linear drive is dependent on continuous control of the current to achieve and maintain a desired position which requires expensive control circuitry and drivers.

BRIEF DESCRIPTION OF THE INVENTION

The invention relates to a positive displacement pump which overcomes the above-mentioned problem by means of a device having the features described in the embodiments below and a method having the features described in the embodiments below.

In a first embodiment of a device in accordance with the present invention the positive displacement pump is provided with a linear piezo-motor for driving the pump which provides precision positioning with simple drive circuity In a second embodiment of a device in accordance with the present invention a positive displacement pump is provided with a linear piezo-motor for driving the pump and a linear encoder which ensures the accuracy and repeatability of positioning of the movable member of the pump.

In a further embodiment of the present invention the linear encoder is in direct connection with the piston or other movable member of a positive displacement pump which removes the need for a linkage (which is a potential course of errors) between the movable member and the encoder.

In another embodiment of the present invention the linear encoder is in direct connection with the bellows of a bellows pump which ensures the accuracy and repeatability of positioning of the bellows.

In an additional embodiment of the present invention the linear encoder is in direct connection with the shaft of a bellows pump which removes the need for a linkage (which is a potential course of errors) between the bellows and the encoder.

In a first embodiment of a method in accordance with the present invention the linear piezo-motor may be operated to move the bellows over the full range of possible expansion and contraction of the bellows. The invention further relates to methods for accurately dispensing small volumes of liquid with good repeatability using a positive displacement pump actuated by a linear piezo motor in which the dispensing of the liquid takes place when the motor is stationary after building up a positive pressure in the pump and the dispensing is controlled by opening a valve and closing it after a programmed or otherwise predetermiend length of time. This ensures accurate droplet size.

DETAILED DESCRIPTION OF THE INVENTION

In the following all the pressures mentioned are gauge pressures unless otherwise described.

Figure 1:
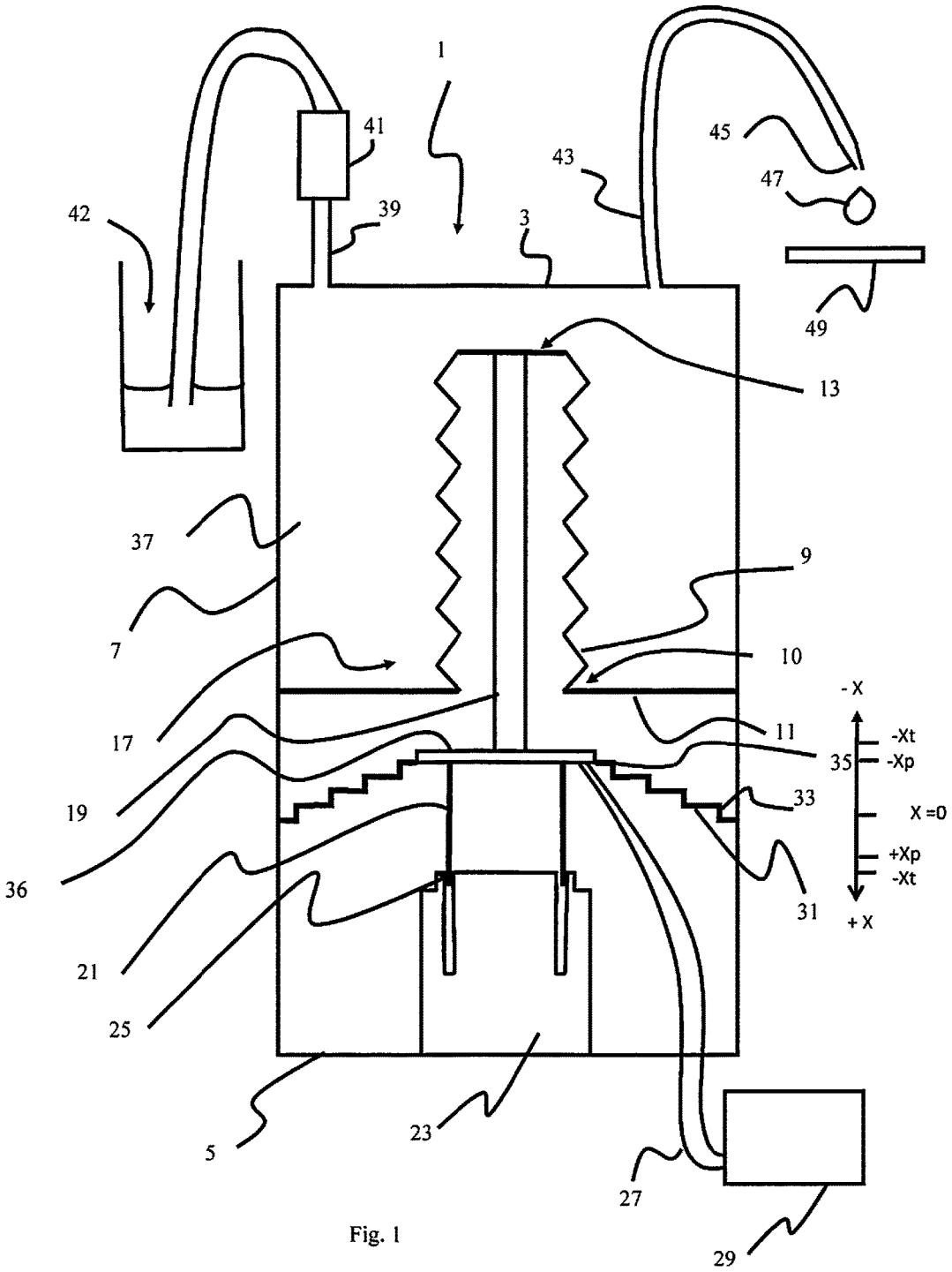
FIG. 1 shows schematically a section through an embodiment of a prior art bellows pump comprising a voice coil actuator.
Figure 2:
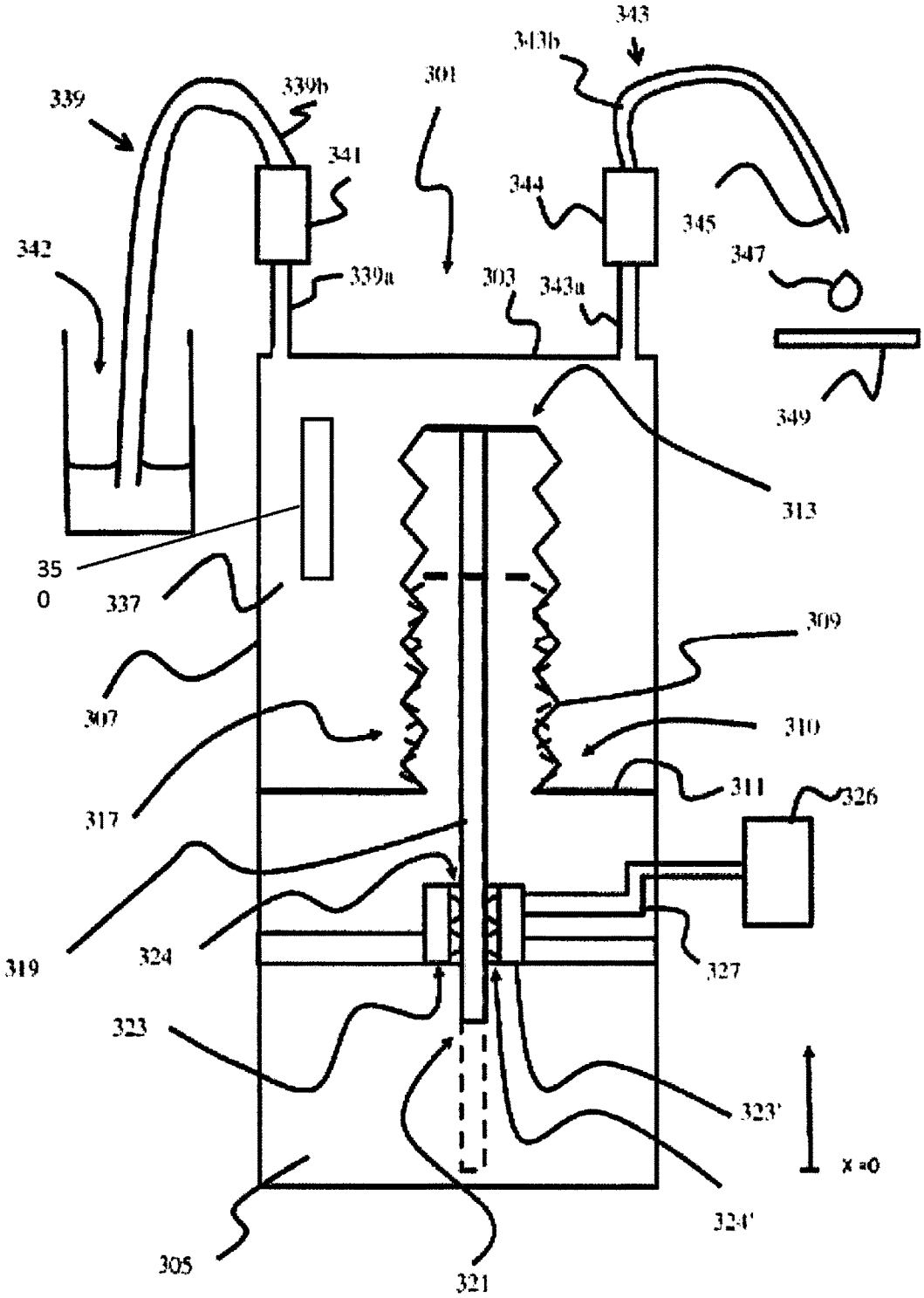
FIG. 2 shows schematically a section through a first embodiment of a bellows pump comprising a piezo motor linear actuator in accordance with the present invention.

FIG. 2 shows schematically a first embodiment of a positive displacement pump in accordance with the present invention.

A positive displacement pump in accordance with the present invention comprises a body 301 having a top cover 303, a bottom 305 and a cylindrical jacket 307 there between. A flexible bellows 309 is placed centrally in the space defined by the jacket 307. The bellows may be a nickel/cobalt bellows or fiber reinforced plastic bellows or the like. The lower end 310 of the bellows 309 is attached to an intermediate wall 311 which extends across the jacket. A portion of the bellows such as the opposite, movable end 313 of the bellows is arranged for linear movement in the axial directions of the bellows and the jacket 307 of the body. The movable end 313 of the bellows is moved by an actuator 317 formed of an axially extending rod 319 and a linear actuator 321 attached to the cover 303 or bottom 305 of the body. The linear actuator 321 is arranged to move in the rod back and forth in the axial direction of the body.

Figure 3A:
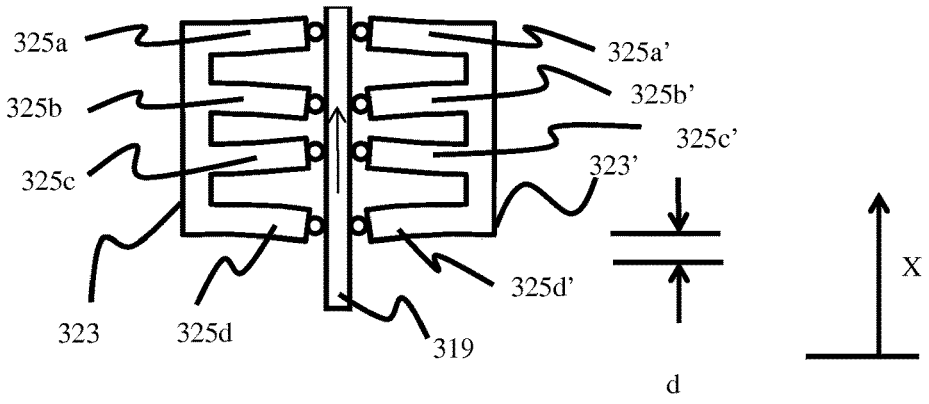
FIGS. 3*a*)-3*d*) show schematically how a walking linear actuator can be actuated to move a rod.
Figure 3B:
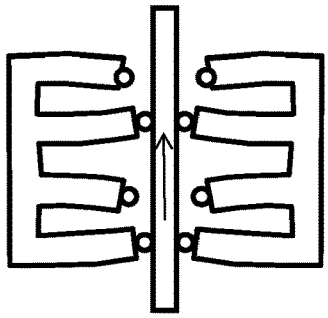
Figure 3C:
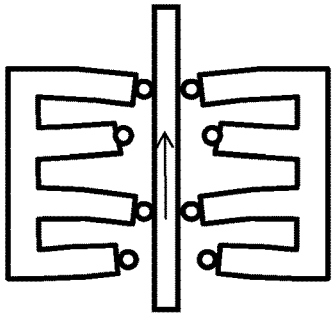
Figure 3D:
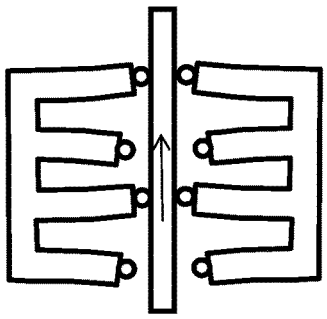

Preferably the linear actuator is a "walking" linear actuator which comprises at least one linear piezo-motor—in FIG. 2 two piezo motors 323, 323' are shown arranged on opposite sides of the rod and connected to each other by an upper tie-bar 324 and a lower tie bar 324'. As shown in more detail in FIGS. 3*a*)-3*d*) (in which the tie bars are omitted for clarity), each linear piezo-motor has a plurality of deformable legs 325*a*-325*d*, 325*a*'-325*d*' which are operable in a forward and a reverse direction to displace the rod axially. The piezo-motor is controlled by electrical signals which may be generated by a control means such as a microprocessor 326 and passed to the piezo-motor 323, 323' through conductors 327. The signals cause selected legs to bend and straighten and co-ordination between the signals can cause the legs to move the rod forwards in a first direction, e.g. towards the bottom of the body or to move the rod backwards in the opposite direction towards the cover of the body. In the absence of a signal the legs grip the rod and resist any movement of the rod as shown in FIG. 3*a*). The legs 325*a*-325*d*, 325*a*'-325*d*' are operable in pairs, so that, if for example the first pairs of legs of each linear motor, comprising legs 325*b* and 325*d*, respectively 325*b*' and 325*d*' of each linear motor, are operated to bend and move the rod a step d in the direction X, then the second pairs of legs comprising legs 325*a* and 325*c*, respectively 325*a*' and 325*c*' retract away from the rod in the opposite direction (i.e. −X) as shown in FIG. 3*b*). Further movement of the rod in the X direction is achieved by actuating the second pairs of legs that initially retracted to now extend to grip and push the rod in the X direction (as shown in FIGS. 3*c*) and 3*d*) while the first pairs of legs which initially pushed the rod in direction X now retract from the rod and bend in the direction −X. Each such step is determined by the structure of the linear motors and can be of the order of 5 micrometer or even less. As the legs grip the rod when there is no signal being supplied to them, no energy is required to maintain the rod in a position.

A liquid chamber 337 filled with the liquid to be dosed is formed between the outside of the bellows 309, the intermediate wall, the jacket and the cover. The dosing operation carried out by the device is based on changes of volume of said liquid chamber caused by movement of the bellows. The liquid chamber 337 has a filling channel 339 with a first channel segment 339*a* which leads from the liquid chamber to a loading valve 341 which can allow or prevent the flow of liquid in the filling channel and thus acts as a valve for preventing flow to or from the liquid chamber. The filling channel 339 has a second segment which leads from the loading valve 341 to a liquid supply 342. A first segment 343*a* of dosing channel 343 leads from the liquid chamber to a dosing valve 344 which is connected by a second segment of dosing channel 343*b* to a dosing tip 345 for discharging the dosed liquid amount in the form of droplets 347. Dosing valve 344 can be operated to open in order to allow flow through the dosing channel 343 or closed to prevent flow through the dosing channel 343. The device may be used for producing test strips for chemical analyses onto a substrate 349. Such test strips or chips comprise arrays of small test regions where each test region contains reagents which have been added to a liquid and which are dispensed in the liquid in the form of droplets. The liquid in the dispensed droplets subsequently has been allowed to evaporated, leaving the reagent on the surface of the substrate. In order that the test strip should give consistent results when used it is important that the amount of reagent in each test region is as nearly the same as possible. Liquid droplets 347 can be injected on the strip 349 from the dosing tip 347. The positive displacement pump shown may be used in productive serial dosing wherein the liquid chamber 337 is filled with the liquid to be dosed, and thereafter, tens or even hundreds of small liquid doses having an accurately-controlled volume may be dosed by means of the actuator 317 expanding the bellows and thereby constricting the liquid chamber to cause the dosing operations.

When a positive displacement pump is being used the amount of a given liquid dispensed from the dosing tip depends mainly on the pressure inside the pump (the "system pressure") and the opening time of the dispensing valve. Pumps can be calibrated by dispensing onto a microscale droplets at known pressures and known valve opening times and measuring the weight of each droplet. The results of these tests can be saved in an electronic or physical calibration table which gives the volume of droplet dispensed per known system pressure and valve opening time. This enables the user to determine what pressure and valve opening time is necessary to dispense a desired droplet volume. When a series of droplets are to be dispensed the user can determine the desired dispensing pressure and appropriate set valve opening time from the calibration table. Preferably calibration is performed for a number of system pressures. For example it may be determined that at a desired dispensing pressure of 40 kPa a valve opening time of 1200 μs will allow 50 nl of fluid to be dispensed while at a higher pressure, for example 60 kPa a valve opening time of 800 μs allows 50 nl of fluid to be dispensed.

A dispensing cycle in a dispensing method according to the invention has the steps of loading liquid into the liquid chamber, pressuring the liquid and dispensing one or more droplets until the pressure in the liquid drops to a predetermined minimum value or the liquid is exhausted after which, in order to allow further dispensing, it is necessary to load more liquid into the liquid chamber. In such a method during the dispensing step during the time that the dispensing valve is open the linear actuator is stationary and it is the previously accumulated pressure in the liquid chamber from the earlier movement of the linear actuator which causes the expulsion of a droplet from the dosing tip when the dosing valve is opened.

In one example of a dispensing method according to the present invention, the desired system pressure and set valve opening time are determined for the predetermined desired droplet volume and inputted into the control system or set manually. In the event that several different combinations of system pressure and valve opening times could give the desired droplet volume than in general a higher pressure and a shorter opening time reduces the possibility that the droplet will cling to the dosing tip instead of being dejected. However too high a pressure also leads to high ejection velocities which may be disadvantageous—for example these can lead to the droplet being atomized or braking up on impact.

Calibration may also be used to find the range of movement of the linear actuator over which the distance moved by the linear actuator gives substantially the same change in volume of the liquid chamber. This may be achieved by moving the motor/bellows some fixed distance, opening the valve and then closing it after a predetermined time and measuring the weight of dispensed liquid by microbalance. After this the pump may be further is tested by dispensing the full pump stroke in small amounts (for example 1 μl) to determine the range of movement of the motor/bellows over which the dispensed volume stays linear i.e. the range of movement where a movement of x gives a dispensed volume of y.

During dispensing of a liquid, the value of the actual system pressure for a set dispensing valve opening time needed to dispense a droplet of a predetermined desired volume may actually be different to the value shown in the calibration table. This can be due to differences in the properties of the liquid being dispensed, changes in the pump system, wear and tear, etc. For example the actual dispensing pressure needed to dispense 50 nl at a valve opening time of 1200 μs may actually be 41 kPa instead of the value of 40 shown in the calibration table. Thus before dispensing a liquid on a substrate it is therefore necessary to ensure that the pressure in the pump system is the actual pressure which is necessary for the set valve opening time. This is achieved by first pressuring the system to the nominal desired system pressure then dispensing to waste a plurality of droplet during a pressure stabilizing step as described below. Once the pressure has been stabilized the actual dispensing can take place.

In order to start dispensing from a first position, for example the full position (as shown by the bellows and rod with dashed lines in FIG. 2), the loading valve is opened to allow the flow of liquid from the liquid supply 342 into the liquid chamber 337, the dispensing valve 344 is closed, and the linear actuator 321 is operated to retract the bellows to its maximum extent so that the liquid chamber contains the maximum amount of liquid which is to be dispensed. Of course the dispensing does not have to start from this completely full position; this position is merely chosen for the sake of illustrating the method according to the invention. The loading valve 341 is switched to its closed position, thereby preventing liquid from flowing back to liquid supply 342. The linear actuator is operated to move the rod 319 a distance so that the bellows 309 expands, thereby increasing the pressure of the liquid in fluid-contact with the liquid chamber 337, i.e. the fluid in the fluid chamber itself and the portions of the filling channel 339 and the dosing channel 343 in fluid contact with the liquid chamber when the loading valve and dosing valve are closed, until it is equal to the desired system pressure. Preferably the desired, looked-up, system pressure is equal to or greater than 10 kilopascals (kPa) and equal to or less than 100 kilopascals (1 bar). More preferably the desired system pressure is arranged to be equal to or greater than 20 kilopascals and equal to or less than 70 kPa. Even more preferably the desired system pressure is arranged to be equal to or greater than 25 kilopascals and equal to or less than 60 kPa. Most preferably the pressure increase during this pre-dispensing pressurizing step is arranged to be equal to or greater than 30 kilopascals and equal to or less than 50 kPa It appears that the use of such low pressures has produced the unexpected advantage that the volume of the droplets dispensed does not vary much over a dispensing cycle. It is not necessary that the increase in pressure of the liquid inside the liquid chamber 337 is measured directly by a pressure sensor. During calibration of the device the movement of the linear actuator which will cause a known decrease in the volume of the liquid chamber and thus a known increase in the pressure can be determined over the useful range of the variable chamber volume. For example if it is known that for a specific device a movement of 50 μm leads to an increase of pressure of 100 kPa then for that device the maximum predetermined distance that the linear actuator would be programmed to move would be limited to 25 μm if the maximum pressure pre-dispensing pressure is to be kept to 50 kPa.

Once the desired pressurization of the fluid has been obtained, for example a desired pressure of nominally 40 kPa, a pre-dispensing pressure stabilizing step is performed in which the pump is operated to ensure that the actual required dispensing pressure of around 40 kPa (e.g. 41 kPa) which actually gives the desired droplet sized is found and is maintained at a stable value inside the fluid chamber before dispensing commences. First the desired predetermined volume of each of the droplets which are to be dispensed is set, for example 50 nl. The appropriate valve opening time, for example 1200 μs, necessary to dispense this volume at the pre-dispensing pressure is obtained from the calibration data table and set, and the distance that the linear actuator has to move to reduce the volume of the fluid chamber by 50 nl is calculated. For example, if the effective area of a bellows is 50 $mm^2$ then a movement of 1 μm would cause a change in volume of 50 nl and in order to dispense a volume of 50 nl the actuator would be operated in 1 μm steps.

The stable dispensing pressure is achieved as follows:

the method starts with the dispensing valve 344 closed and then the rod is move the required distance to dispense one droplet of the desired size, e.g. 1 μm for a 50 nl droplet. The valve is opened for the set valve opening time, for example 1200 μs, and the droplet dispensed to waste. This sequence is repeated. Preferably the sequence is repeated a plurality of times N, where N is equal to or greater than 50 and equal to or less than 1000, more preferably N is equal to or greater than 100 and equal to or less than 750, even more preferably N is equal to or greater than 150 and equal to or less than 500 and yet more preferably N is equal to or greater than 200 and equal to or less than 350. During this sequence the pressure in the dispensing system will gradually approach the actual required dispensing pressure as, if the pressure is initially too high, then more of the fluid will be dispensed in each droplet then intended, thus lowering the pressure increase caused by the next movement of the rod. Conversely, if the pressure is initially too low, then less fluid than intended will be dispensed during the valve opening time and the subsequent movement of the rod will cause a higher pressure increase than expected. At the end of this sequence the pressure inside the dispensing system will have stabilized at the correct actual required dispensing pressure of, for example, 41 kPa needed to dispense a 50 nl drop during a valve opening period of 1200 μs and the volume of liquid dispensed per valve opening will be the same as the decrease in volume of the fluid chamber caused by the movement of the rod i.e. exactly 50 nl. The use of this pre-dispensing stabilizing method means that it is not necessary to know the exact actual required dispensing pressure in the system as the method ensures that the pressure in the system will converge on that which is necessary for the desired quantity of fluid to be dispensed during the actual valve opening time. In other words during this stabilizing phase the volume of the dispensed droplets will not necessarily be accurate—if the pressure is too high to begin with then the initial droplets will be larger than the change of volume caused by movement of the rod, thus leading to a gradual lowering of the pressure towards the correct pressure. If the pressure is too low to begin with then the initial droplets will be smaller than the change of volume caused by movement of the rod, thus leading to a gradual raising of the pressure towards the desired dispensing pressure.

If instead of being dispensed to waste the droplets are dispensed onto a microscale then, as it is very difficult to measure the weight of a 50 nl droplets, the weight of a series of droplets (e.g. 50 or 100 droplets) is measured. The stabilization can be considered to be complete when the weight difference between two consecutive series of droplet differs by less than a set amount, for example 5% or 3% or 1%.

Following stabilization of the system pressure, dispensing of the fluid onto the intended target may subsequently take place.

This is achieved by moving the rod the predetermined distance necessary to dispense the same predetermined desired volume as used during the stabilization step, e.g. 50 nl, holding the rod stationary and then opening the dispensing valve 344 the same set length of time necessary for a droplet to be dispensed, e.g. 1200 μs . The dispensing valve is then closed. The substrate and/or dispensing tip is/are moved to the position where the next droplet is to be dispensed, the rod is moved the predetermined distance necessary to dispense the desired volume, the dispensing valve is opened again for the set amount of time necessary to dispense the droplet, the droplet is dispensed and the dispensing valve is closed. This cycle of moving the tip or substrate, moving the rod the predetermined distance necessary to dispense the desired volume, opening the dispensing valve for the set time and then closing the dispensing valve is repeated until the required number of droplets have been dispensed or the pump is leaving its calibrated range of movement or the liquid being dispensed is exhausted. Thus during dispensing, movement of the actuator only takes place when liquid flow out of the liquid chamber is prevented and thus the movement of the actuator leads to a rise in pressure in the chamber. Movement of the actuator to fill the liquid chamber is of course allowed.

A piezo linear actuator is a linear actuator in which, in the absence of external influences, the force required to produce a unit change in linear displacement of an actuator rod is independent of the position of the rod as the time that it is being displaced. As described above with reference to FIGS. 2 and 3*a*)-3*d*), the linear actuator is preferably a "walking" piezo linear actuator. Such a linear actuator is self-locking and requires no current and thus generates no heat when stationary. In a well-designed and properly constructed bellows pump system the force required to move the rod remains substantially the same throughout at least the middle range of movement X of the rod. The exception to this is when the rod and actuator system is influenced by mechanical forces related to the construction of the device, for example increasing resistance to motion when the bellows reaches the ends of its travel and no longer deforms uniformly.

With appropriate drive signals the movement of each pair of legs can be synchronized. As the linear actuator is fixed to the device jacket or bottom it cannot move relative to the device jacket or bottom and the movement of the legs is transferred into axial movement of the rod which lies between them. Thus the legs can "walk" the rod back and forth—step by step. With very small legs the distance moved by the rod in one complete step of the linear actuator can also be very small. For example, if the step length of the linear actuator is two micrometer then the rod can be moved in complete steps of two micrometer. Additionally if steps which are smaller than the step length of the device are required then this is also possible by interrupting the movement of the linear actuator while it is performing a step. The drive signals are electrical impulses and these can be delivered at substantially any speed and voltage up to the maximum allowable for the linear actuator. Rapid drive signals will cause rapid stepping of the piezo-motor while slow drive signals will cause slow stepping of the piezo-motor. This means that the speed of movement of the legs can be accurately controlled even at very low speeds such that the movement approaches being a stepless movement, (i.e. an analogue movement). For example, by actuating the linear actuator to move at an illustrative speed of one nanometer per minute it is possible to produce extremely small movements accurately by stopping the movement after a suitable interval of time has passed, e.g. 6 seconds if the desired movement is 0.1 nanometer. The rod can be stopped anywhere along its range of movement to a precision of a fraction of one nanometer. The direct friction coupling between the legs and the rod means that the device will normally operate without any measurable backlash or mechanical play. In addition to giving direct drive the legs also give full force, power-off locking without consuming any power.

It has been found that accurate and reliable dispensing of droplets can be achieved by surprisingly small movements of the linear actuator which generate relatively low pressures in the fluid in the dispensing system.

In a further embodiment of the invention, a positive displacement pump in accordance with the first embodiment of the invention is provided with a linear encoder 350 which measures the displacement of one or more of the linearly moving parts of the pump. The encoder 350 may be provided to measure the linear displacement of the rod and/or the linear displacement of the end or other part of the bellows. Such an encoder 350 allows the actual displacement of the rod and/or bellows to be measured and can be used by the control system to ensure that the actual displacement of the rod and/or bellows corresponds to the desired displacement of the rod and/or bellows thus forming part of a feedback system which can be used to ensure the accuracy of the droplet size and dispensing. Using such an encoder 350, which provide high accuracy, precision and reliability, removes the necessity to perform the more difficult calibration of the pump itself. Such pump calibration may otherwise be required due to variations in the step length between motors and other variations in step length caused by internal friction and by variations in the load on the motor.

The invention has been illustrated by means of one type of bellows displacement pump in which the bellows changes the volume of a liquid-containing chamber arrange outside the bellows. The invention may also be realized using a bellows pump in which the liquid-containing chamber is in interior of the bellows and the liquid is dispensed by moving a movable end of the bellows closer to the opposite end of the bellows, thereby decreasing the volume of the liquid-containing chamber. The invention also may be realized in the form of embodiments of the invention provided with a syringe pump in which the piston rod of the syringe is moved axially by a piezo-linear actuator of the type described above and actuated in a method analogous to that described above. In such devices the piston face of the syringe pump may correspond to the movable portion of the pump and the interior of the syringe cylinder between the piston face and the end face of the syringe correspond to the liquid chamber of the pump. Alternatively the piston may remain stationary and the syringe cylinder have be the movable portion of the pimp.

Any embodiment of the invention may be modified to use a single liquid channel which can be used for aspirating liquid into the liquid chamber of the pump when the chamber is to be filled and which can also be used to dispense liquid when droplets are to be dispensed.

The invention claimed is:

1. Positive displacement pump system for the dispensing of droplets of liquid comprising a pump with a liquid-containing chamber with a movable portion, an actuator adapted to move said movable portion of said chamber for changing the volume of said chamber, a liquid outlet in fluid communication with said chamber, and a dispensing valve for controlling flow through said liquid outlet and control means for controlling said actuator and said valve, characterized in that the pump system comprises a linear encoder which measures the displacement of one or more of the linearly moving parts of the pump and that said actuator is a walking self-locking piezo-linear actuator and that the control means is configured during the dispensing of droplets to:

i) control said actuator to increase the pressure in said chamber before controlling said dispensing valve to dispense a droplet; and, ii) control said actuator so that movement of the actuator only takes place when liquid flow out of the liquid chamber is prevented, and wherein the positive displacement pump is further configured to control, in a pre-dispensing phase, to obtain a stable dispensing pressure:

a) to load said chamber with liquid, b) to set a dispensing valve opening time to a set time;

c) to pressurize said liquid in said chamber to a nominal dispensing pressure; and d) to stabilize the pressure in said chamber at the actual required dispensing pressure by dispensing a plurality of droplets to waste;

wherein each droplet is dispensed by the steps of:

actuating said actuator to move the movable portion of said chamber a predetermined distance in a direction necessary to decrease the volume of said chamber by a predetermined volume of the droplet;

stopping movement of said actuator;

opening said dispensing valve for a predetermined set time; and closing said dispensing valve after said predetermined set time has elapsed.

2. Positive displacement pump according to claim 1 characterized in that said pump is a bellows pump comprising a bellows (309) and wherein said movable portion of said chamber is one end of the bellows.

3. The positive displacement pump system according to claim 2, wherein said linear encoder is in direct connection with the bellows or a shaft of the bellows pump.

* * * * *